US012194586B2

(12) United States Patent
Crenshaw

(10) Patent No.: US 12,194,586 B2
(45) Date of Patent: Jan. 14, 2025

(54) SANDING SYSTEMS, METHODS, AND DEVICES

(71) Applicant: DC PRECISION CERAMICS, LLC, Gilbert, AZ (US)

(72) Inventor: David Crenshaw, Gilbert, AZ (US)

(73) Assignee: DC PRECISION CERAMICS, LLC, Gilbert, AZ (US)

( * ) Notice: Subject to any disclaimer, the term of this patent is extended or adjusted under 35 U.S.C. 154(b) by 0 days.

(21) Appl. No.: 18/724,343

(22) PCT Filed: Jan. 5, 2023

(86) PCT No.: PCT/US2023/010196

§ 371 (c)(1),
(2) Date: Jun. 26, 2024

(87) PCT Pub. No.: WO2023/133196

PCT Pub. Date: Jul. 13, 2023

(65) Prior Publication Data

US 2024/0416477 A1 Dec. 19, 2024

Related U.S. Application Data

(60) Provisional application No. 63/297,604, filed on Jan. 7, 2022.

(51) Int. Cl.
*B24B 21/18* (2006.01)

(52) U.S. Cl.
CPC ..... *B24B 21/18* (2013.01)

(58) Field of Classification Search
None
See application file for complete search history.

(56) References Cited

U.S. PATENT DOCUMENTS 2,486,869 A * 11/1949 Nicholas ..... B43K 1/08 401/211
2,521,038 A * 9/1950 Canaday, Jr. ..... B43K 1/08 401/209

(Continued)

FOREIGN PATENT DOCUMENTS

CN 110977702 A 4/2020
CN 113370039 A * 9/2021

(Continued)

OTHER PUBLICATIONS

Patent Cooperation Treaty, International Search Report and Written Opinion, Application No. PCT/US2023/10196, dated Aug. 9, 2023.

(Continued)

*Primary Examiner* — Joel D Crandall
*Assistant Examiner* — Jonathan R Zaworski
(74) *Attorney, Agent, or Firm* — SNELL & WILMER L.L.P.

(57) ABSTRACT

An adaptable belt sander may comprise: a tool holder; a housing; a drive system comprising a first gear and a second gear configured to engage the first gear, the second gear coupled to a shaft; and a belt system comprising a belt extending from the shaft to a distal end of the adaptable belt sander, the adaptable belt sander configured to travel along a belt path in response to rotation of the shaft, the distal end having a rotating apparatus configured to engage the belt.

8 Claims, 12 Drawing Sheets

(56) References Cited

U.S. PATENT DOCUMENTS 2,646,776 A * 7/1953 Scholz ..... B43K 1/08 401/211
2,654,108 A * 10/1953 Scelsi ..... A45D 34/041 401/209
3,524,284 A * 8/1970 Mears ..... B24B 19/26 451/303
3,643,385 A * 2/1972 Mikiya ..... B24B 23/06 451/355
3,942,288 A * 3/1976 Schmidt ..... B23Q 7/035 451/239
4,578,906 A * 4/1986 Appleton ..... B24B 23/06 D8/62
4,735,019 A * 4/1988 Wiederkehr ..... B24B 19/02 451/340
4,940,350 A * 7/1990 Kim ..... A45D 34/041 401/209
5,210,981 A * 5/1993 Urda ..... B24B 23/06 451/296
6,527,629 B1 * 3/2003 Sandvold ..... B24B 9/007 451/299
6,592,435 B2 * 7/2003 Kishima ..... G11B 5/84 451/63
6,761,617 B2 * 7/2004 Tozawa ..... B23Q 5/043 451/5
7,424,930 B2 * 9/2008 Bizlewicz ..... F16F 15/021 181/207
7,648,298 B2 * 1/2010 Gueret ..... A45D 34/041 401/211
7,662,024 B2 * 2/2010 Bechtold ..... B24B 41/04 451/310
9,156,120 B2 * 10/2015 Kosonen ..... B24B 21/14
9,511,468 B2 * 12/2016 Suzuki ..... B24B 23/06
10,618,139 B2 * 4/2020 Sun ..... B24B 21/00
2004/0229553 A1 * 11/2004 Bechtold ..... B24B 13/01 451/42
2015/0360339 A1 12/2015 Suzuki
2020/0114484 A1 * 4/2020 Nakazono ..... B24B 21/08
2022/0266409 A1 * 8/2022 Laser ..... B24B 21/002
2022/0331929 A1 * 10/2022 Carter ..... B24B 47/12

FOREIGN PATENT DOCUMENTS

EP 2025464 A1 2/2009
EP 3533564 A1 9/2019
WO 2021099926 A1 5/2021

OTHER PUBLICATIONS

Patent Cooperation Treaty, Preliminary Report on Patentability, Application No. PCT/US2023/10196, dated Apr. 22, 2024.

* cited by examiner

SECT A-A

SANDING SYSTEMS, METHODS, AND DEVICES

CROSS REFERENCE TO RELATED APPLICATIONS

This application is a U.S. national stage entry under 35 U.S.C. § 371 of International Application No. PCT/US2023/010196 filed Jan. 5, 2023 entitled "SANDING SYSTEMS, METHODS, AND DEVICES", which claims priority to and the benefit of U.S. Provisional Application No. 63/297,604 entitled "SANDING SYSTEMS, METHODS, AND DEVICES," filed on Jan. 7, 2022. The disclosure of the foregoing applications are incorporated herein by reference in their entirety, including but not limited to those portions that specifically appear hereinafter, but except for any subject matter disclaimers or disavowals, and except to the extent that the incorporated material is inconsistent with the express disclosure herein, in which case the language in this disclosure shall control.

TECHNICAL FIELD

The present disclosure relates to sanding systems, methods, and devices, in particular to systems and methods for efficiently sanding a three-dimensional component.

BACKGROUND

Computer numerical control ("CNC") machines process a piece of material (e.g., metal, plastic, wood, ceramic, or composite) to meet specifications by following a coded programmed instruction and without a manual operator. CNC machines utilize drills, saws, etc., to machine the material to meet the desired specifications. Machined components often have rough surfaces, which can make meeting tighter flatness tolerances difficult. In this regard, improved components and systems for improving surface roughness of three-dimensional printed components may be desirable.

SUMMARY

An adaptable belt sander is disclosed herein. The adaptable belt sander may comprise: a tool holder configured to couple to a computer numerical control (CNC) machine; a housing coupled to the tool holder; a drive system comprising a first gear coupled to the tool holder and a second gear configured to engage the first gear, the second gear coupled to a shaft; and a belt system comprising a belt extending from the shaft to a distal end of the adaptable belt sander, the adaptable belt sander configured to travel along a belt path in response to rotation of the shaft, the distal end having a rotating apparatus configured to engage the belt.

In various embodiments, the adaptable belt sander may further comprise a damping system coupled to the housing, the damping system configured to dampen a force of a contact surface of the belt during operation of the adaptable belt sander. The damping system may comprise a rod and a piston housing. The rotating apparatus may comprise a wheel coupled to the piston housing of the damping system. The rotating apparatus may comprise a spherical ball configured to engage a second distal end of the piston housing of the damping system. The adaptable belt sander may further comprise a magnet disposed in the piston housing, the magnet configured to attract the spherical ball. An outer portion of the spherical ball may comprise a polymeric material. The adaptable belt sander may further comprise a disengagement pin coupled to the housing, the disengagement pin configured to keep the housing in a stationary position relative to the tool holder during operation.

An adaptable belt sander is disclosed herein. The adaptable belt sander may comprise: a tool holder configured to couple to a computer numerical control (CNC) machine; a housing coupled to the tool holder; a drive system comprising a turbine disposed in the housing, a first gear, and a second gear configured to engage the first gear, the second gear coupled to a shaft; and a belt system comprising a belt extending from the shaft to a distal end of the adaptable belt sander, the adaptable belt sander configured to travel along a belt path in response to rotation of the shaft, the distal end having a rotating apparatus configured to engage the belt.

In various embodiments, the turbine is configured to rotate in response to receiving a fluid. The fluid may be a coolant. The tool holder may remain stationary during operation. The adaptable belt sander may further comprise a damping system coupled to the housing, the damping system configured to dampen a force of a contact surface of the belt during operation of the adaptable belt sander, the damping system comprising a rod and a piston housing, the rod coupled to a lateral support, the piston housing slidably coupled to the housing. The rotating apparatus may comprise a wheel coupled to a second distal end of the piston housing. The rotating apparatus may comprise a spherical ball engaging a second distal end of the piston housing. The adaptable belt sander may further comprise a magnet disposed in the piston housing, the magnet configured to attract the spherical ball.

A method of sanding a component is disclosed herein. The method may comprise: coupling a first belt sander to a spindle of a computer numerical control (CNC) machine; sanding the component with the first belt sander; swapping the first belt sander with a second belt sander via the CNC machine; and sanding the component with the second belt sander.

In various embodiments, the first belt sander has a first belt having a first material and the second belt sander has a second belt having a second material, the second material being different than the first material. The first belt sander may have a first belt system extending from a first shaft to a spherical ball and the second belt sander may have a second belt system extending from a second shaft to a wheel. The spherical ball may include an outer portion comprising a polymeric material, and the wheel may include a metallic material.

BRIEF DESCRIPTION OF THE DRAWINGS

With reference to the following description and accompanying drawings.

DETAILED DESCRIPTION

Figure 1A:
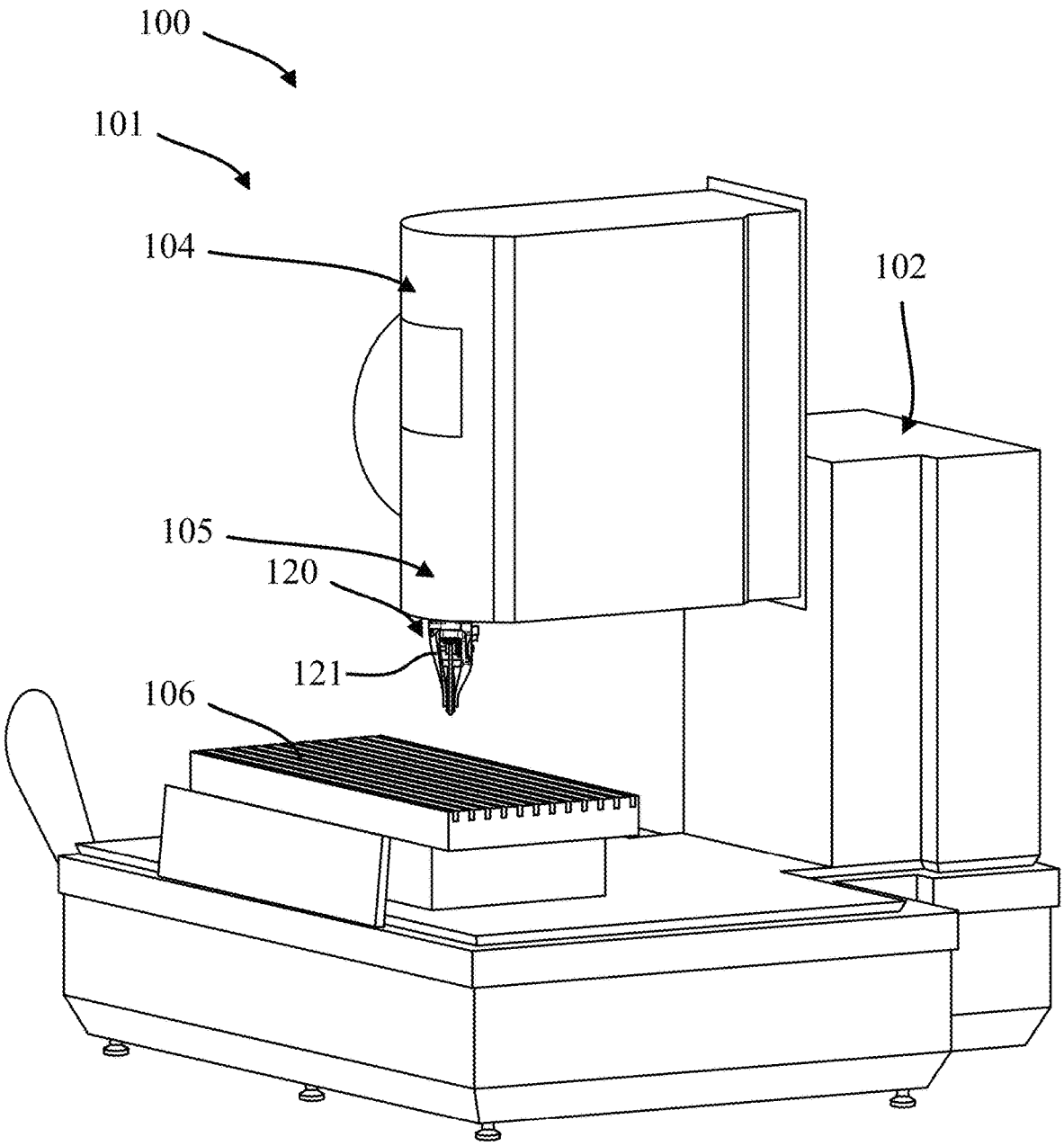
FIG. 1A illustrates a perspective view of a computer numerical control (CNC) machining system, in accordance with various embodiments.

The following description is of various exemplary embodiments only and is not intended to limit the scope, applicability or configuration of the present disclosure in any way. Rather, the following description is intended to provide a convenient illustration for implementing various embodiments, including the best mode. As will become apparent, various changes may be made in the function and arrangement of the elements described in these embodiments without departing from principles of the present disclosure.

For the sake of brevity, conventional techniques and components may not be described in detail herein. Furthermore, the connecting lines shown in various figures contained herein are intended to represent exemplary functional relationships and/or physical couplings between various elements. It should be noted that many alternative or additional functional relationships or physical connections may be present in exemplary systems and/or components thereof.

In various embodiments, various components for producing more detailed three-dimensional components in a more efficient manner relative to typical systems and methods is disclosed herein. For example, an adaptable belt sander is disclosed herein, which is adaptable to be mounted to a CNC machine. Additionally, the adaptable belt sander comprises a belt system configured to sand, or polish, a component for surface finishing purposes. In this regard, the adaptable belt sander comprises a belt configured to translate along a path and engage a surface of a component to be sanded. In various embodiments, the predetermined path may be a racetrack type path. However, the present disclosure is not limited in this regard. For example, the path may be circular, oval, or the like, in accordance with various embodiments. Although described herein as traveling continuously along the predetermined path, the present disclosure is not limited in this regard. For example, a belt configured to oscillate between opposite directions is within the scope of this disclosure, in accordance with various embodiments.

The adaptable belt sander comprises a housing with a removeable mounting plate. The housing is configured to house the belt of the belt system therebetween. The removeable mounting plate is removable to facilitate changing of the belt in the belt system in response to repair or in response to swapping out a different belt for various application (i.e., when a material being sanded changes).

In various embodiments, the adaptability of the adaptable belt sander disclosed herein may greatly reduce a manufacturing time and cost for ceramic components. For example, in some cases, ceramic materials, such as silicon carbide, may have a hardness greater than tools of CNC machines, such as drills, lathes, mills, or the like. Thus, ceramic materials may have to be worked with in a different manner. Upon switching between materials typically used with CNC machines, such as aluminum, brass, magnesium, stainless, steel, carbon steel, titanium or the like to a ceramic material like silicon carbide, a tool changer of the CNC machine may swap out a CNC tool (e.g., a drill, a lathe, a mill, or the like) with the belt sander disclosed herein. Thus, various materials may be worked with limited time associated with set-up in between, in accordance with various embodiments.

Referring now to FIG. 1A, a perspective view of a manufacturing system 100 is illustrated, in accordance with various embodiments. The manufacturing system 100 may comprise a CNC machine 101. In various embodiments, the CNC machine 101 comprises a CNC tool 120 (e.g., a subtractive component configured for a subtractive manufacturing process, such as a mill, a lathe, a drill, an adaptable belt sander 121, etc.). In various embodiments, the adaptable belt sander 121 may be swappable, via the CNC machine 101, with a typical subtractive tool, such as a mill, a lathe, or a drill. In this regard, the adaptable belt sander 121 is adaptable to CNC machines. The CNC machine 101 can be configured for subtractive manufacturing of a respective component along three to five axis (e.g., along an X-Y-Z axis, along X-Y-Z axis and a rotational axis, along X-Y-Z axis and two rotational axis, or as many axis as current CNC machines enable). In various embodiments, adaptable belt sander 121 disclosed herein is adaptable to any CNC machine 101 having a spindle configured to receive various subtractive components.

Figure 1B:
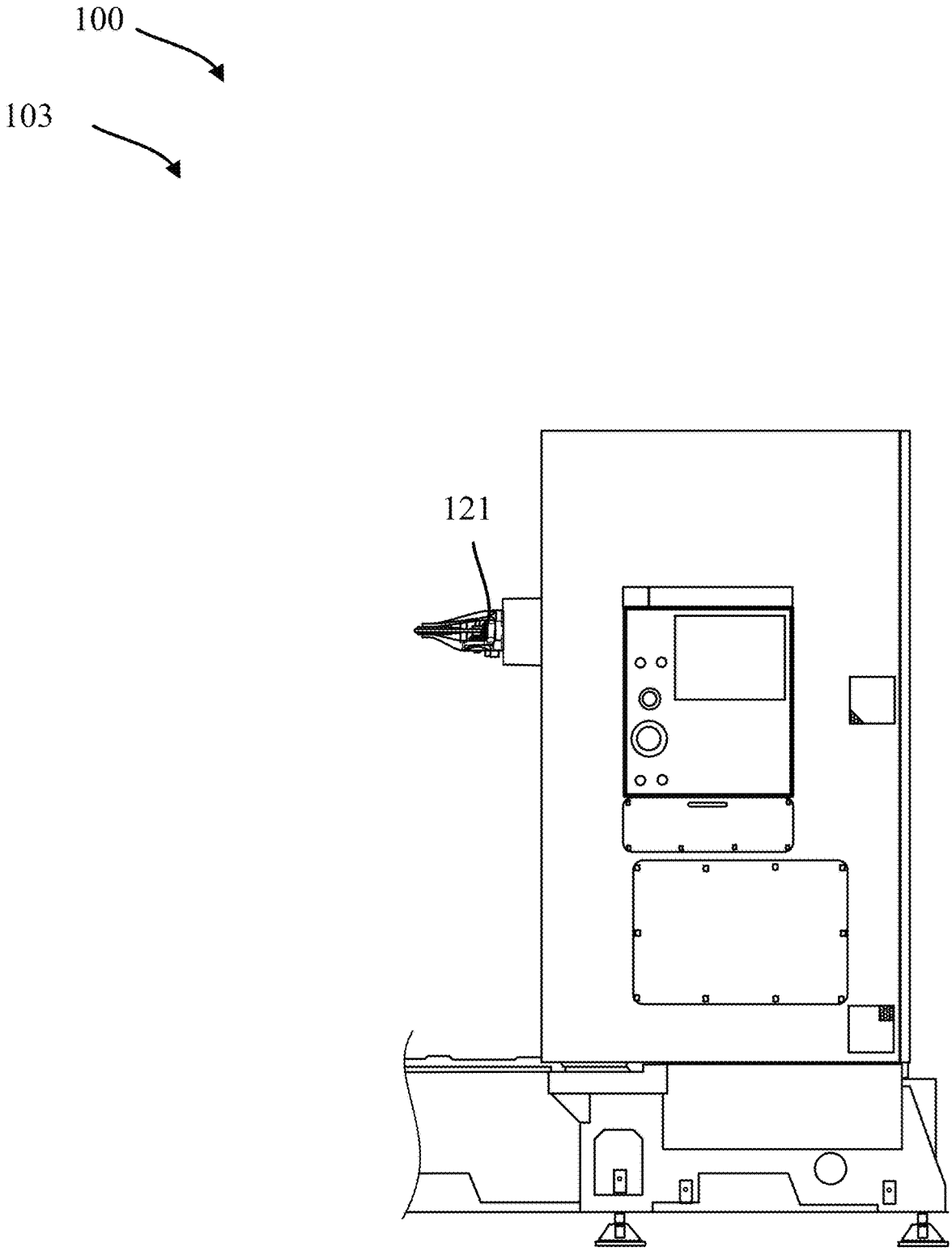
FIG. 1B illustrates a computer numerical control (CNC) machining system, in accordance with various embodiments.

The manufacturing system 100 can comprise a vertical machining system (e.g., CNC machine 101 from FIG. 1A) or a horizontal machining system (e.g., CNC machine 103 from FIG. 1B). The present disclosure is not limited in this regard.

In various embodiments, the CNC machine 101 further comprises a first frame 102, a second frame 104, and a worktable 106. The second frame 104 and the worktable 106 may each be coupled to the first frame 102. The second frame 104 includes a spindle 105. The spindle 105 comprises a motor, a taper for holding tools (referred herein as a "spindle"), and a shaft that holds together the separate components. During operation, a controller of the CNC machine 101 is configured to be in electronic communication with the adaptable belt sander 121 and/or control the adaptable belt sander 121 to generate a smoother component relative to typical systems, in accordance with various embodiments.

Figure 2:
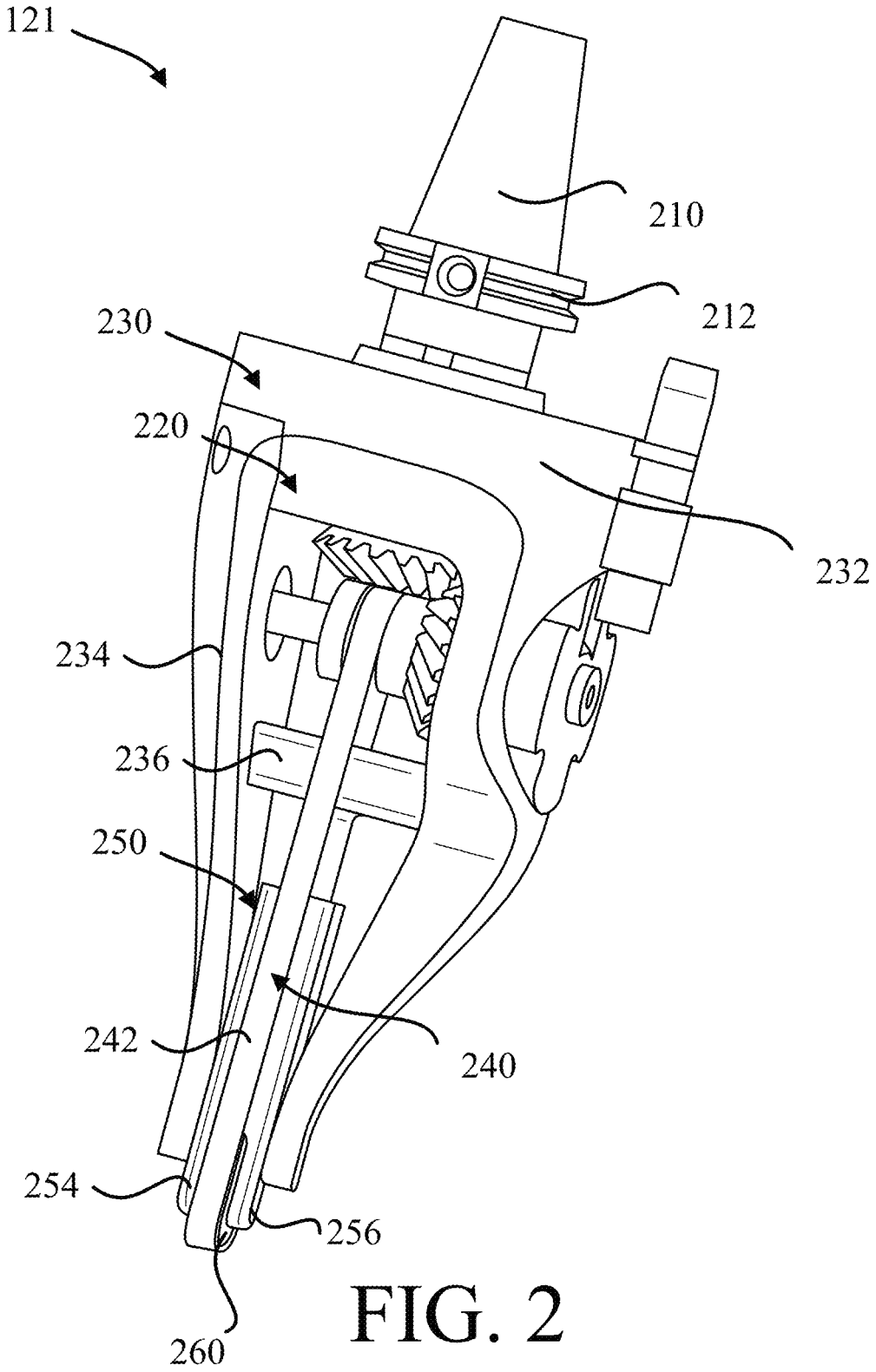
FIG. 2 illustrates a perspective view of a belt sander adaptable for a CNC machining system, in accordance with various embodiments.

Referring now to FIG. 2, a perspective view of the adaptable belt sander 121 is illustrated, in accordance with various embodiments. The adaptable belt sander 121 comprises a drive system 220, a housing 230, a belt system 240, and a damping system 250.

The drive system 220 is configured to drive the belt system 240. For example, the drive system 220 is operably and mechanically coupled to the belt system 240. The drive system 220 is also configured to mechanically couple to a spindle 105 of a CNC machine 101 from FIG. 1A or CNC machine 103 from FIG. 1B. In this regard, when coupled to the CNC machine 101, the CNC machine 101 provides a mechanical input, in response to a command from a controller, to drive system 220 and thus also driving the belt system 240. The drive system 220 comprises a tool holder 210 (i.e., tapered component) that is configured to operatively couple to a spindle 105 of the CNC machine 101, 103 of FIGS. 1A, 1B. For example, the tool holder 210 comprises a mount 212 configured to engage the tool holder and couple the tool holder 210 to the tool holder.

In various embodiments, the housing 230 at least partially houses various components of the adaptable belt sander 121 and fixes various rotation components in an axial direction, while allowing the rotational components to rotate about a respective axis as described further herein. In various embodiments, the belt system 240 is disposed at least partially within the housing 230 (e.g., laterally between a main structure 232 and a mounting plate 234).

In various embodiments, the housing 230 comprises a lateral support 236 disposed between the main structure 232 and the mounting plate 234. The lateral support 236 may provide structural rigidity to the adaptable belt sander 121, in accordance with various embodiments.

In various embodiments, the damping system 250 is coupled to the housing 230 and configured to engage the belt system 240. In this regard, due to the hardness of material being sanded with the adaptable belt sander 121, the damping system 250 may be configured to compress in response to the belt 242 contacting a bump, or the like during sanding.

In various embodiments, a rotating apparatus 260 is disposed at a distal end 256 of the piston housing 254. The rotating apparatus 260 may be rotatably coupled to the piston housing 254, configured to engage the piston housing 254 or the like as described further herein. In this regard, the rotating apparatus 260 is configured to translate with the piston housing 254 in response to the belt 242 of the belt system 240 contacting a bump, or the like during sanding/polishing. In various embodiments, the damping system 250 may be spring loaded, gas pressure loaded, or the like. The present disclosure is not limited in this regard.

Figure 10:
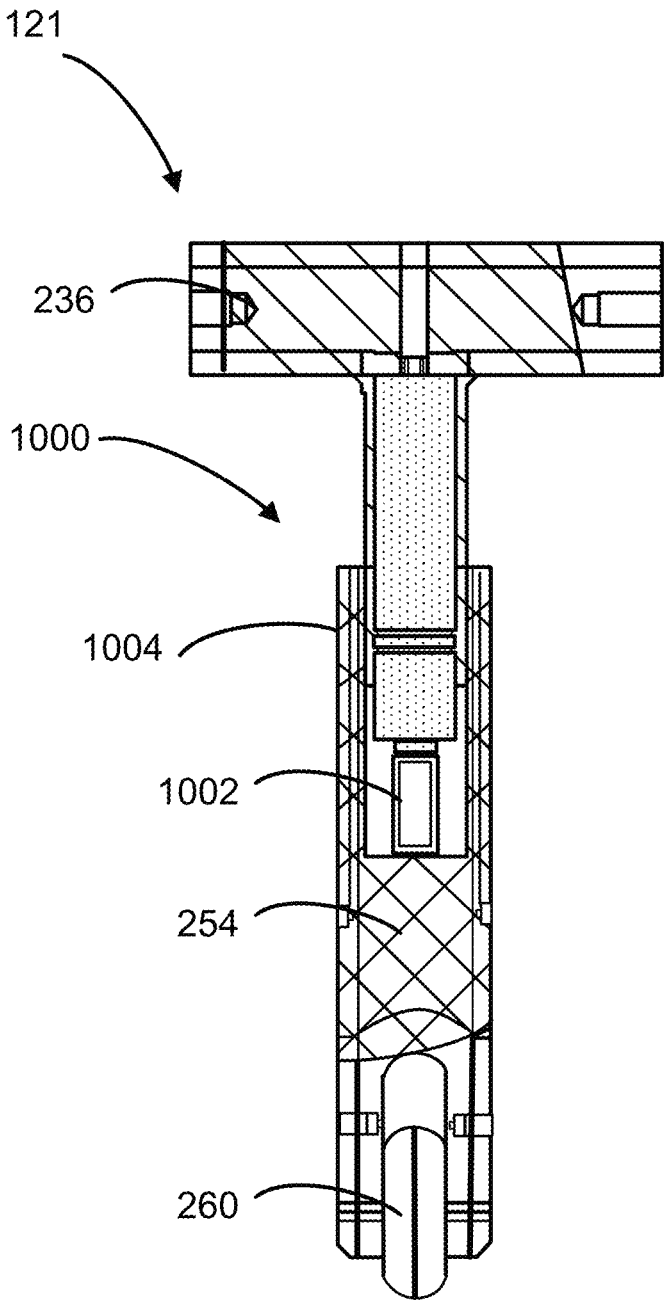
FIG. 10 illustrates a cross-sectional view of a gas strut of an adaptable belt sander, in accordance with various embodiments.

With brief reference now to FIG. 10, a cross-sectional view of a gas shock strut 1000 of the adaptable belt sander 121 is illustrated, with like numerals depicting like elements, in accordance with various embodiments. The gas shock strut 1000 can comprise a hydro-pneumatic element that sores potential energy by compressing gas contained inside an enclosed housing as described further herein. The gas shock strut 1000 can comprise the piston housing 254, a compression pin 1002, and a gas strut body 1004. In various embodiments, the gas shock strut 1000 allows for the compression of the piston housing 254 and rotating apparatus 260 for easy removal of the belt 242 of the belt system 240 when replacement is needed. In various embodiments, the gas shock strut can also provide cushioning for the unplanned impact from irregularities in the part being sanded or a relief if a mistake is made in the programming of the CNC machine 101, 103 to prevent damage to the adaptable belt sander 121 and/or the CNC machine 101, 103.

Figure 7:
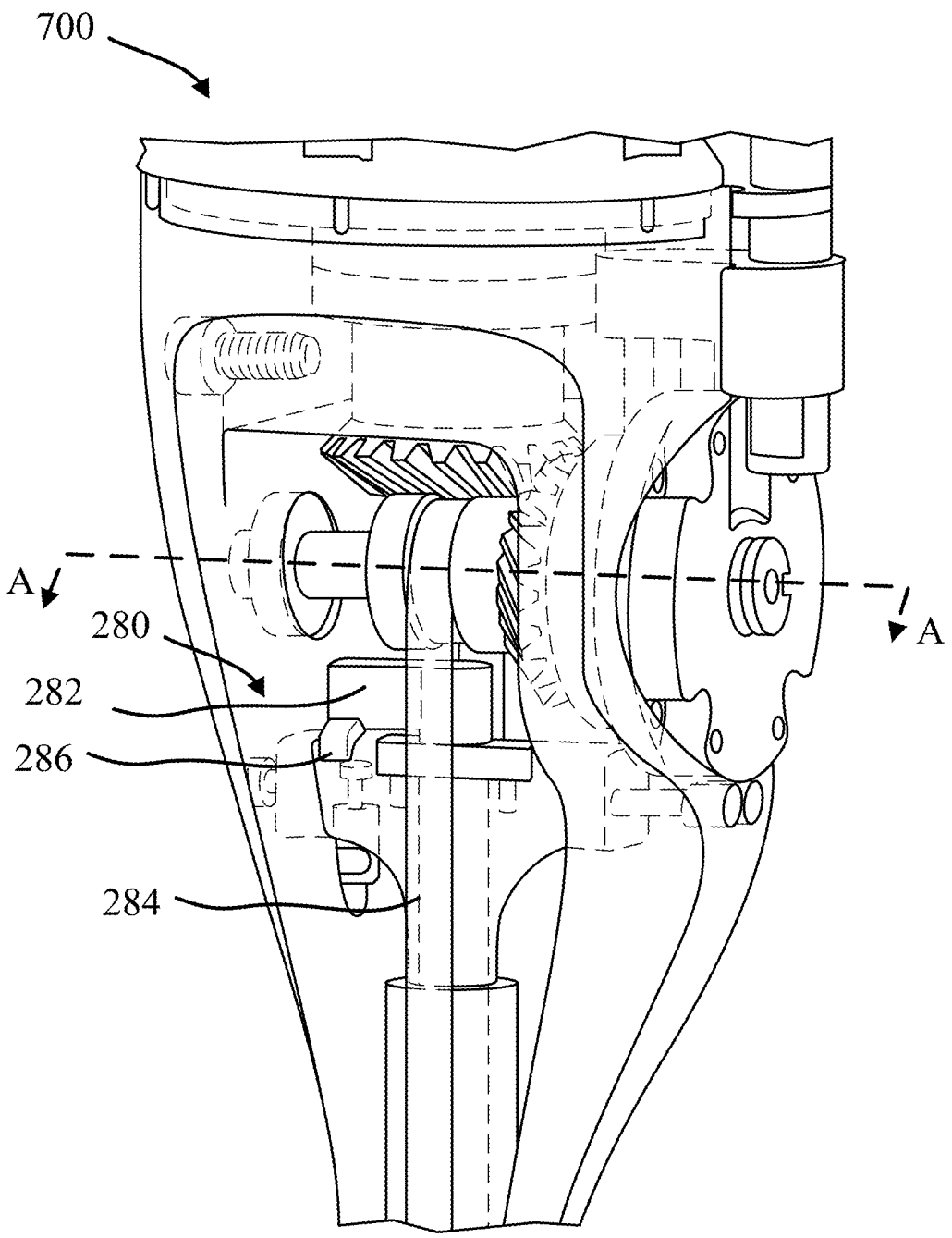
FIG. 7 illustrates a perspective view of a belt sander adaptable for a CNC machining system, in accordance with various embodiments.

Referring back to FIG. 2, although illustrated as including the damping system 250 with the piston housing 254, the present disclosure is not limited in this regard. For example, with brief reference to FIG. 7, a perspective view of a belt sander 700 with an end cam assembly 280 is illustrated, in accordance with various embodiments. The belt sander 700 is in accordance with the adaptable belt sander 121 with the exception that the damping system 250 is replaced with the end cam assembly 280. In this regard, the end cam assembly 280 comprises an end cam 282 coupled to a rod 284 that extends to the rotating apparatus 260 from FIG. 2.

Figure 8A:
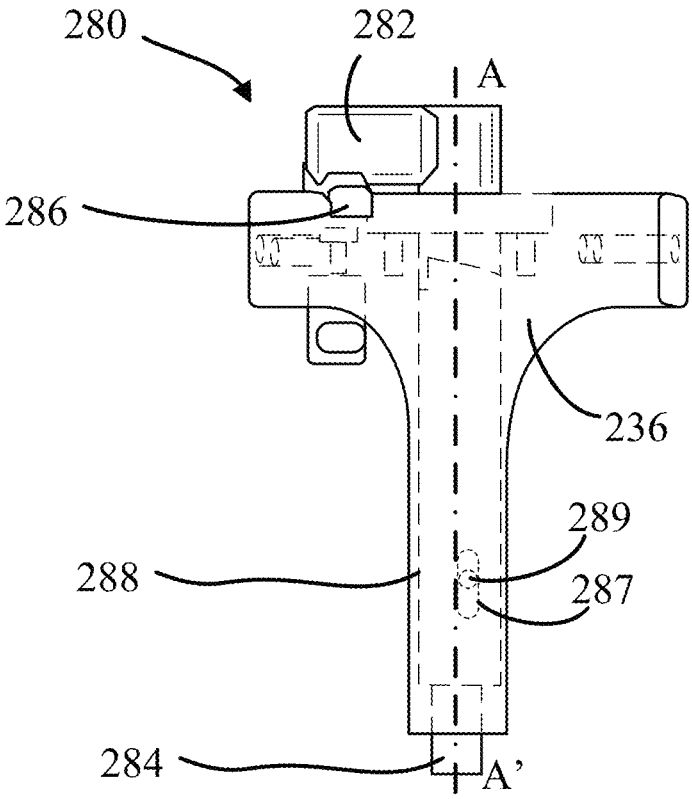
FIG. 8A illustrates a front view of an end cam assembly in an engaged state, in accordance with various embodiments.
Figure 8B:
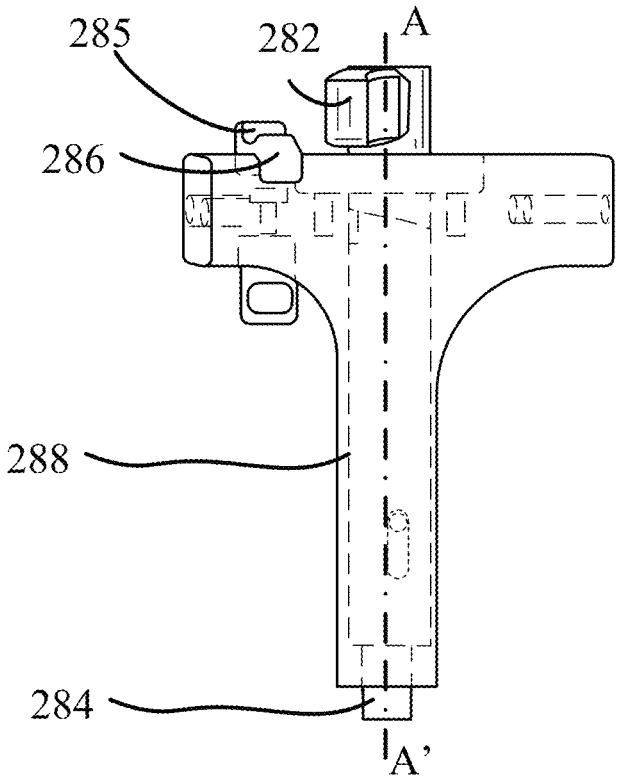
FIG. 8B illustrates a front view of a cam assembly in a released state, in accordance with various embodiments.

Referring now to FIGS. 8A-8B, a detailed view of the cam assembly 280 in a released state (FIG. 8B) and in an engaged state (FIG. 8A) are illustrated, in accordance with various embodiments. The cam assembly 280 comprises an end cam 282 disposed at a first axial end of the lateral housing 236, a rod housing 288, and the rod 284 disposed in the rod housing 288. In various embodiments, the cam assembly 280 further comprises a slot 287 disposed in the rod housing 288 and a pin 289 extending from the rod 284 in a radially outward direction into the slot 287. In various embodiments, the slot 287 is configured to guide the pin 289, and the rod 284, in an axial direction in response to rotation of the end cam 282 as described further herein.

The rod 284 is configured to extend in response to transitioning the end cam 282 from a released state (FIG. 8B) to an engaged state (FIG. 8A). In this regard, by extending the rod 284 in response to engaging the end cam 282 in an engagement switch 286, the belt 242 from FIG. 2 is tightened for increased rigidity of the belt sander 700 and/or to allow for increased dimensional accuracy for a respective CNC machine 101, 103. In various embodiments, the engagement switch 286 can have multiple engagement grooves. In this regard, the cam assembly 280 can facilitate an adjustable tightness for the belt 242 of the belt system 240 as shown in FIG. 2. In various embodiments, removing the gas piston or spring of the damping system 250 from FIG. 2 removes compression caused by the piston or spring, thereby generating increased accuracy for the belt sander 700.

In various embodiments, the cam assembly 280 is operationally coupled to the lateral support 236. Stated another way, the end cam 282 and the rod housing 288 are configured to rotate about an axis A-A' defined by the rod 284 relative to the lateral support 236, which remains fixed during operation of the cam assembly 280. In response to rotation of the end cam 282 and the rod housing 288, the rod 284 is configured to translate axially along the axis A-A'. Stated another way, the rod 284 is guided axially within the rod housing 288 (i.e., via a helical interface or the like). Accordingly, the end cam assembly 280 is configured to tighten (or loosen) the belt 242 of the belt system 240, in accordance with various embodiments.

Figure 3A:
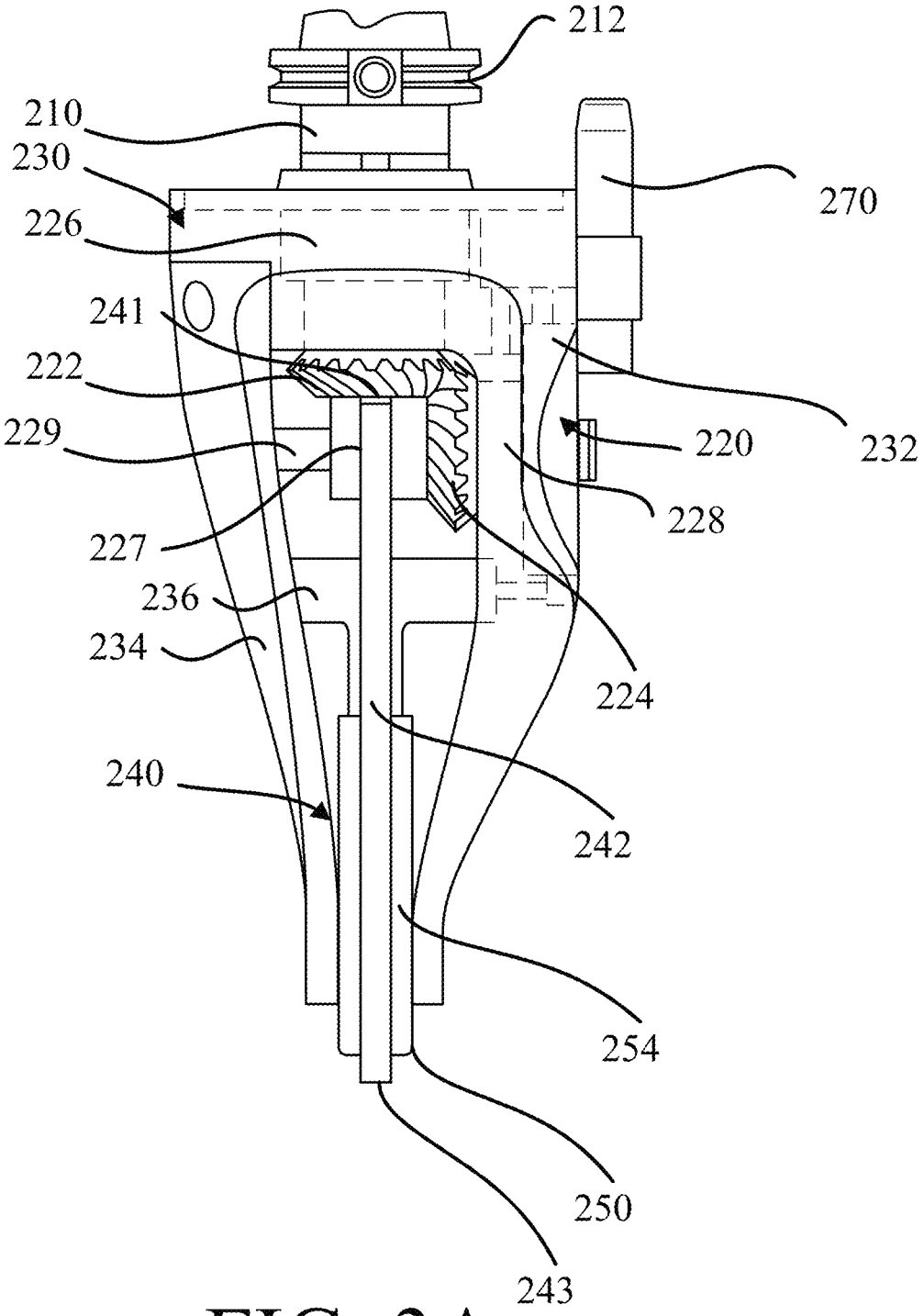
FIG. 3A illustrates a front view of a belt sander, in accordance with various embodiments.

Referring now to FIG. 3A, a front view of the adaptable belt sander 121 is illustrated, in accordance with various embodiments. The drive system 220 comprises a tool holder 210, a first gear 222 and a second gear 224. Although illustrated herein with gears 222, 224 being mechanically coupled, the present disclosure is not limited in this regard. For example, magnetic gears are within the scope of this disclosure. In various embodiments, the tool holder 210 is configured to be driven by a spindle 105 of a CNC machine 101 from FIG. 1A or CNC machine 103 from FIG. 1B. In this regard, in response to a spindle 105 of the CNC machine 101 from FIG. 1A or CNC machine 103 from FIG. 1B engaging the tool holder 210, the spindle 105 of the CNC machine 101 and the tool holder 210 are configured to rotate together, thus rotating first gear 222. In response to first gear 222 rotating about an axis defined by the first gear 222, the second gear 224 rotates about an axis defined by the second gear 224 causing the belt system 240 to operate.

In various embodiments, the drive system 220 further comprises a first bearing assembly 226 and a second bearing assembly 228. The first bearing assembly 226 is operably coupled to a shaft coupling the tool holder 210 to the first gear 222. Thus, the first bearing assembly 226 comprises a plurality of bearings configured to support and guide the shaft, which rotates with respect to the housing 230. Similarly, the second bearing assembly 228 comprises a plurality of bearings configured to support and guide a shaft 229 of drive system 220. The shaft 229 extends laterally from the main structure 232 of the housing 230 to the mounting plate 234 of the housing. Thus, the shaft 229 is configured to rotate relative to the housing 230 along a shaft axis. As tool holder 210 rotates about a central axis defined by the tool holder 210, a first gear 222 of the drive system 220 rotates about the central axis as well. In this regard, the first gear 222 may cause a second gear 224 in the drive system 220 to rotate about a second axis defined by a centerline of the second gear 224, in accordance with various embodiments. Thus, the first gear 222 is configured to operatively engage the second gear 224 (e.g., via bevel gears or the like), in accordance with various embodiments. In various embodiments, the drive system 220 of the adaptable belt sander 121 further comprises first bearing assembly 226 disposed within the housing 230 and configured to facilitate rotation of the first gear 222 via the tool holder 210.

In various embodiments, the adaptable belt sander 121 further comprises a lateral support 236 extending from the main structure 232 laterally to the mounting plate 234. The lateral support 236 may be configured to provide lateral support to the housing 230. Additionally, the lateral support 236 may be coupled to a piston rod 252 of the damping system 250. In this regard, the lateral support 236 may provide structural support, and act as a fixed end, for damping system 250.

In various embodiments, the damping system 250 further comprises a piston housing 254 (e.g., a cylinder). Although referred to as a cylinder, the piston housing 254 is not limited in this regard and may have an outer shape corresponding to, and configured to interface with, the housing 230 as shown in FIG. 2.

In various embodiments, the adaptable belt sander 121 further comprises a disengagement pin 270 coupled to the housing. The disengagement pin 270 is configured to orient the adaptable belt sander 121 with respect to a CNC machine 101 from FIG. 1A or CNC machine 103 from FIG. 1B. In this regard, the disengagement pin 270 is configured to engage a receptacle in a spindle 105 of the CNC machine 101 from FIG. 1A or CNC machine 103 from FIG. 1B. Additionally, the disengagement pin 270 is configured to keep the housing 230 stationary during operation of the belt sander (i.e., during rotation of the tool holder 210 and various components of drive system 220.

Figure 3B:
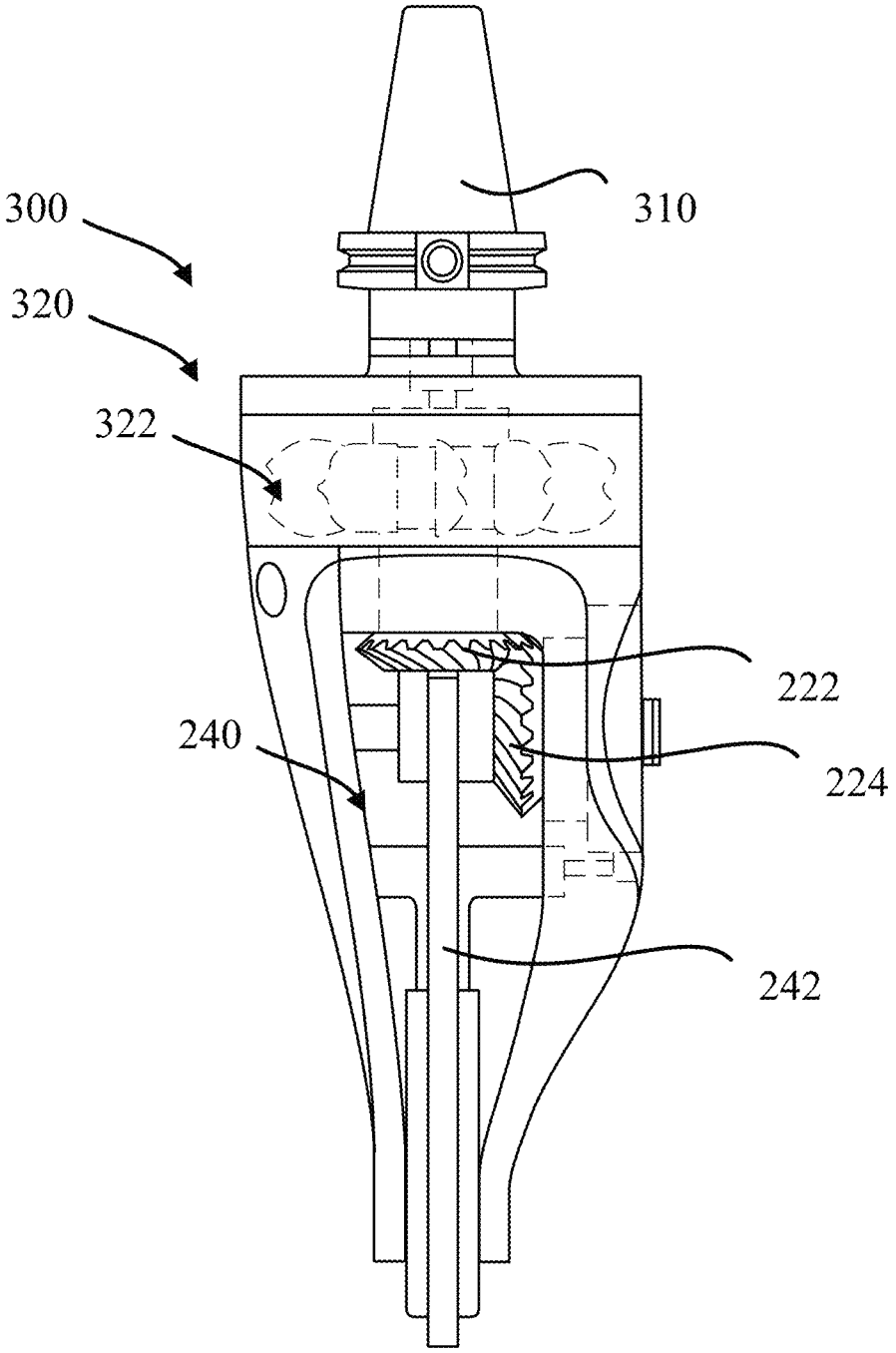
FIG. 3B illustrates a front view of a belt sander, in accordance with various embodiments.

Although illustrated in FIG. 3A as driving gears 222, 224 via the tool holder 210, the present disclosure is not limited in this regard. For example, with brief reference to FIG. 3B, a drive system 320 for an adaptable belt sander 300 may comprise a turbine 322. The adaptable belt sander 300 may be in accordance with adaptable belt sander 121 except as otherwise described herein. In various embodiments, the turbine 322 may comprise a Pelton turbine design (i.e., the turbine 322 may be configured to rotate irrespective of the tool holder 310), an impeller, or the like. The present disclosure is not limited in this regard. In various embodiments, the turbine 322 may be configured to rotate in response to compressed fluid (e.g., air, coolant, etc.) blowing on a bucket of each turbine blade in the turbine 322. Accordingly, the drive system 320 of FIG. 3B may include a stationary tool holder 310, and a drive system 320 utilizing fluid to drive the gears 222, 224 via the turbine 322. An adaptable belt sander 300 may eliminate a disengagement pin 270 from adaptable belt sander 121 as the tool holder 310 remains stationary during operation. In this regard, a size of the adaptable belt sander 300 may be reduced compared to a size of the adaptable belt sander 121. Additionally, the fluid provided may be a coolant that is also in fluid communication with the belt 242 of the belt system 240 and configured to lubricate the belt 242 during operation.

In various embodiments, referring back to FIG. 3A, the housing 230 comprises the main structure 232 and the mounting plate 234. The main structure 232 is coupled to the mounting plate 234 (e.g., via fasteners or the like). The mounting plate 234 provides structural rigidity to the belt system 240, supports the shaft 229, and prevents flexing of a belt 242 of the belt system 240 during operation, in accordance with various embodiments. The mounting plate 234 is removable from the main structure 232 to facilitate a changing of a belt 242 in the belt system 240. In this regard, once a belt has reached a useful life, the belt may be swapped out with a replacement belt by removing the mounting plate 234 and coupling the replacement belt to the shaft 229 and the rotating apparatus 260 from FIG. 2.

The main structure 232 houses the shaft extending from the tool holder 210 to the first gear 222, thus enabling the first gear 222 to rotate with the shaft and the tool holder 210, in accordance with various embodiments. The main structure 232 may further house the first bearing assembly 226 and the second bearing assembly 228. In this regard, the plurality of bearings of the first bearing assembly 226 are configured to facilitate rotation of the shaft extending between the tool holder 210 and the first gear 222 and the second bearing assembly 228 is configured to facilitate rotation of the shaft 229 relative to the housing 230.

In various embodiments, the second gear 224 of the drive system 220 is coupled to the shaft 229 configured to rotate with the second gear 224. In this regard, in response to the shaft 229 rotating, a belt 242 of the belt system 240 travels along a racetrack type path from a first end 241 (i.e., proximate the first gear 222) to a second end 243 (i.e., distal to the first gear 222 and proximate a component being sanded or polished). In this regard, the belt 242 engages a groove 227 of the shaft 229. In this regard, the groove 227 is configured to guide the belt 242 of the belt system 240 along the racetrack type path in response to rotating with the shaft 229.

In various embodiments, the belt 242 comprises an abrasive material, such as silicon carbide, aluminum oxide, or any other abrasive material configured for sanding ceramics or the like. In various embodiments, the belt 242 may be configured to engage the groove 227 and shaft 229 such that the belt 242 travels along the racetrack type path as described previously herein.

Figure 4:
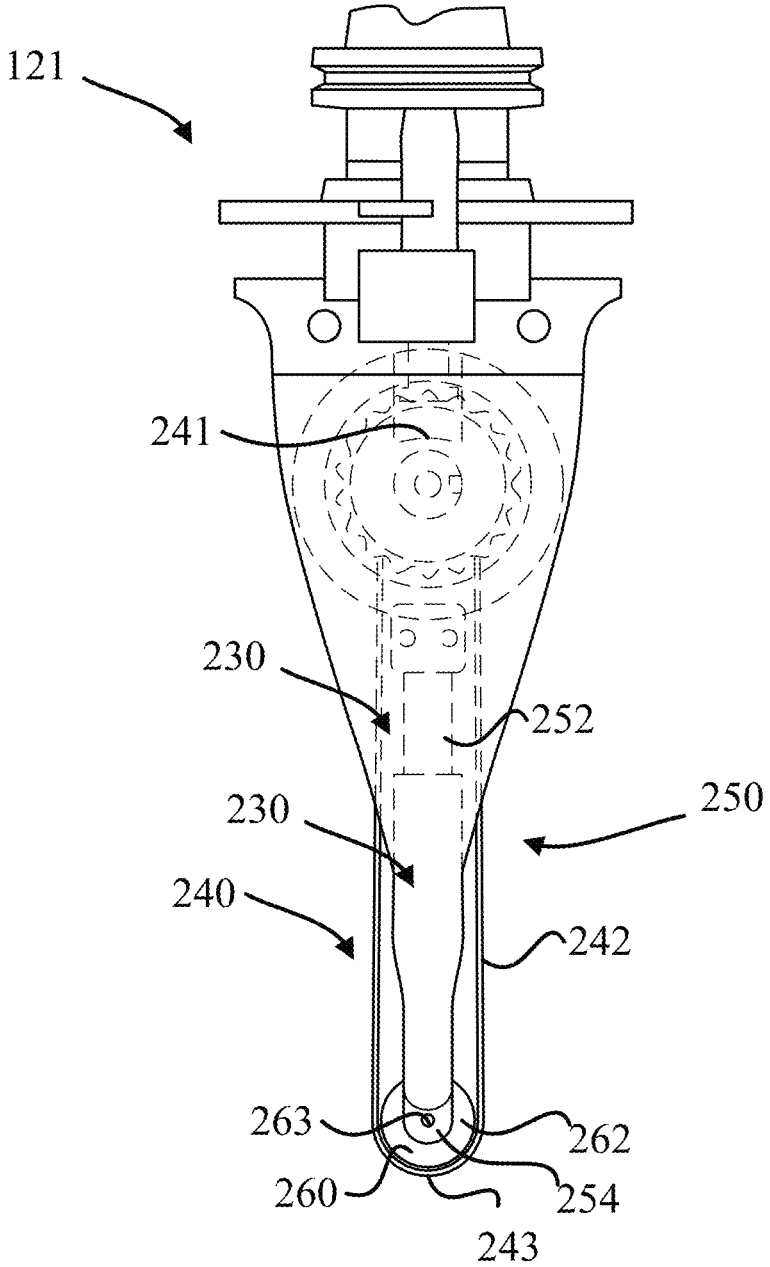
FIG. 4 illustrates a side view of a belt sander, in accordance with various embodiments.

Referring now to FIG. 4, a side view of the adaptable belt sander 121 from FIG. 2 is illustrated, in accordance with various embodiments. The rotating apparatus 260 of the adaptable belt sander 121 may further comprise a wheel 262 rotatably coupled to the piston housing 254. The wheel 262 may be coupled to a pin 263. The pin 263 is configured to rotate about an axis defined by the pin 263. In various embodiments, the pin 263 is rotatably coupled to the piston housing 254. In this regard, the pin 263 and the wheel 262 are configured to rotate together about the pin axis during operation of the adaptable belt sander 121, in accordance with various embodiments. In various embodiments, the piston housing 254 is configured to translate relative to the housing 230 in a vertical direction (i.e., along an axis defined by the piston rod 252 of damping system 250). For example, the piston housing 254 may be slidingly coupled to the housing 230, in accordance with various embodiments. Thus, the housing 230 may guide the piston housing 254.

In various embodiments, the belt 242 is configured to engage a rotational component (e.g., a wheel or a spherical ball) at the second end 243 of the belt system 240. In this regard, during operation, the belt 242 travels from the first end 241 to the second end 243 on a first side of the adaptable belt sander 121 to around the rotational component of the damping system 250 at the second end 243 and back to the first end 241.

Thus, in various embodiments, a wheel 262 is disposed at the second end of the belt 242 and the belt system 240 is configured to travel linearly from the first end to the second end along a first side, around the wheel 262 and linearly on a second side from the second end to the first end, in accordance with various embodiments.

In various embodiments, the wheel 262 may comprise various materials. For example, the wheel 262 may be made of an iron-based alloy, a nickel-based alloy, a titanium-based alloy, or the like. In various embodiments, the wheel 262 is made of an iron-based alloy, such as stainless steel.

Figure 5:
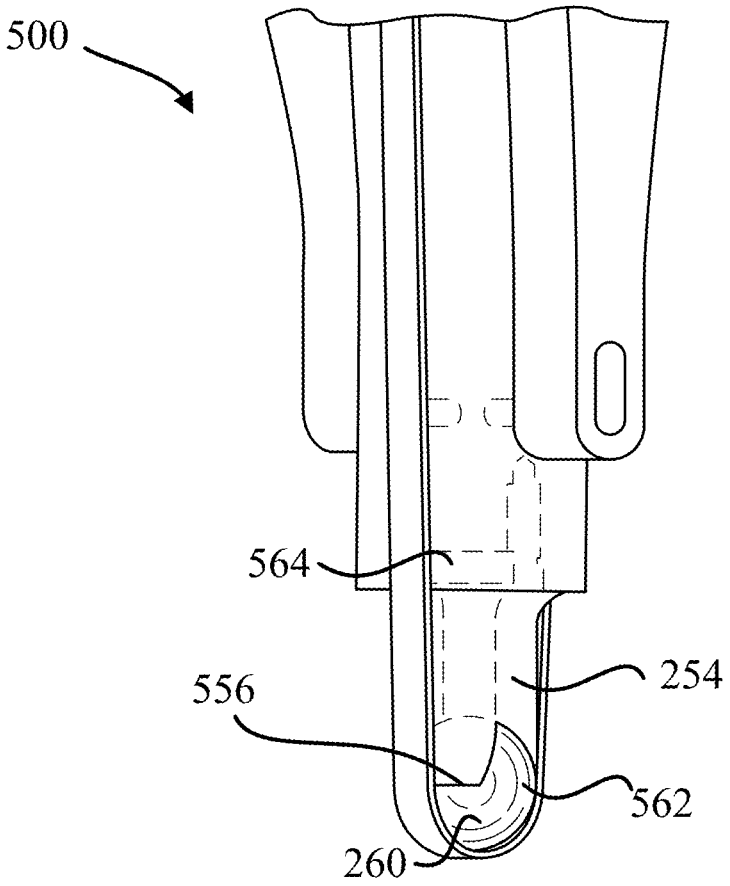
FIG. 5 illustrates a perspective view of a portion of a belt sander, in accordance with various embodiments.

Although illustrated as comprising the wheel 262, the present disclosure is not limited in this regard. For example, with reference now to FIG. 5, the rotating apparatus 260 may comprise a spherical ball 562. The spherical ball 562 may be held in place by a magnet 564 disposed in the piston housing and configured to pull the spherical ball 562 towards the magnet 564 and against a distal end 556. In this regard, the distal end 556 may comprise a spherical groove configured to receive the spherical ball 562. In various embodiments, the spherical ball includes an iron, nickel, cobalt, or any other attractive element to magnets within the spherical ball 562. In various embodiments, the spherical ball 562 further comprises a polymeric material, such as neoprene rubber, silicone, nitrile, styrene-butadiene, butyl, fluorosilicone, or the like.

In various embodiments, the spherical ball 562 facilitates having the polymeric contact material described previously herein. The polymeric contact material may provide additional damping to a surface being sanded or polished that has a greater number of anomalies or surface roughness relative to the metallic contact material for the wheel 262 from FIG. 4. The wheel 262 from FIG. 4 provides greater contact for the belt 242 when sanding or polishing steep contours. Thus, an adaptable belt sander 121 with the wheel 262 from FIG. 4 as described herein and an adaptable belt sander 500 with a spherical ball 562 as described herein both have their own advantages relative to each other. In various embodiments, the adaptable belt sander 500 may be in accordance with adaptable belt sander 121 or adaptable belt sander 300, except as otherwise described herein.

Figure 6:
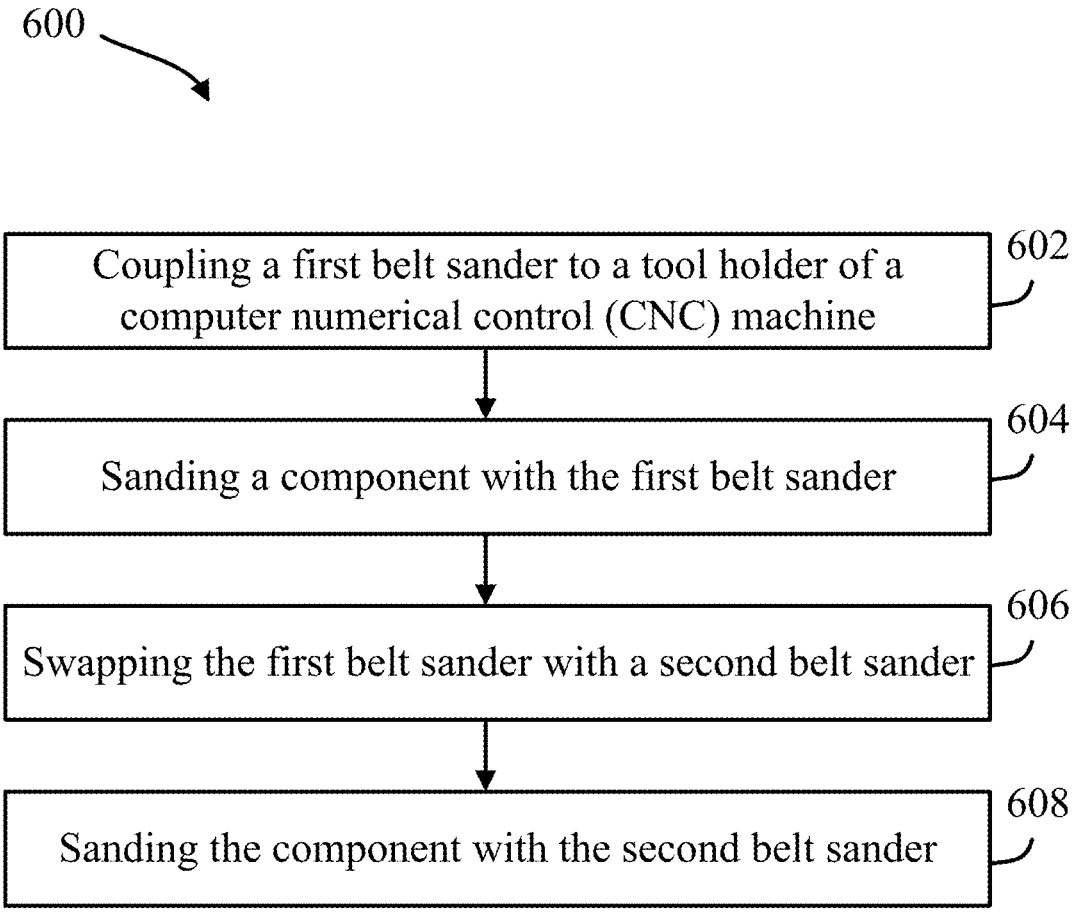
FIG. 6 illustrates a method for sanding or polishing a component, in accordance with various embodiments.

In various embodiments, an adaptable belt sander 500 having the spherical ball 562 may be utilized first in a sanding process, swapped out with a second adaptable belt sander 121 having the wheel 262 (e.g., a metallic wheel, a thermoplastic wheel, a ceramic wheel) from FIG. 4, and re-sanding the component with the second adaptable belt sander 121 having the wheel 262 (e.g., a metallic wheel). For example, with reference now to FIG. 6, a method 600 for sanding and/or polishing a component is illustrated, in accordance with various embodiments.

Figure 9:
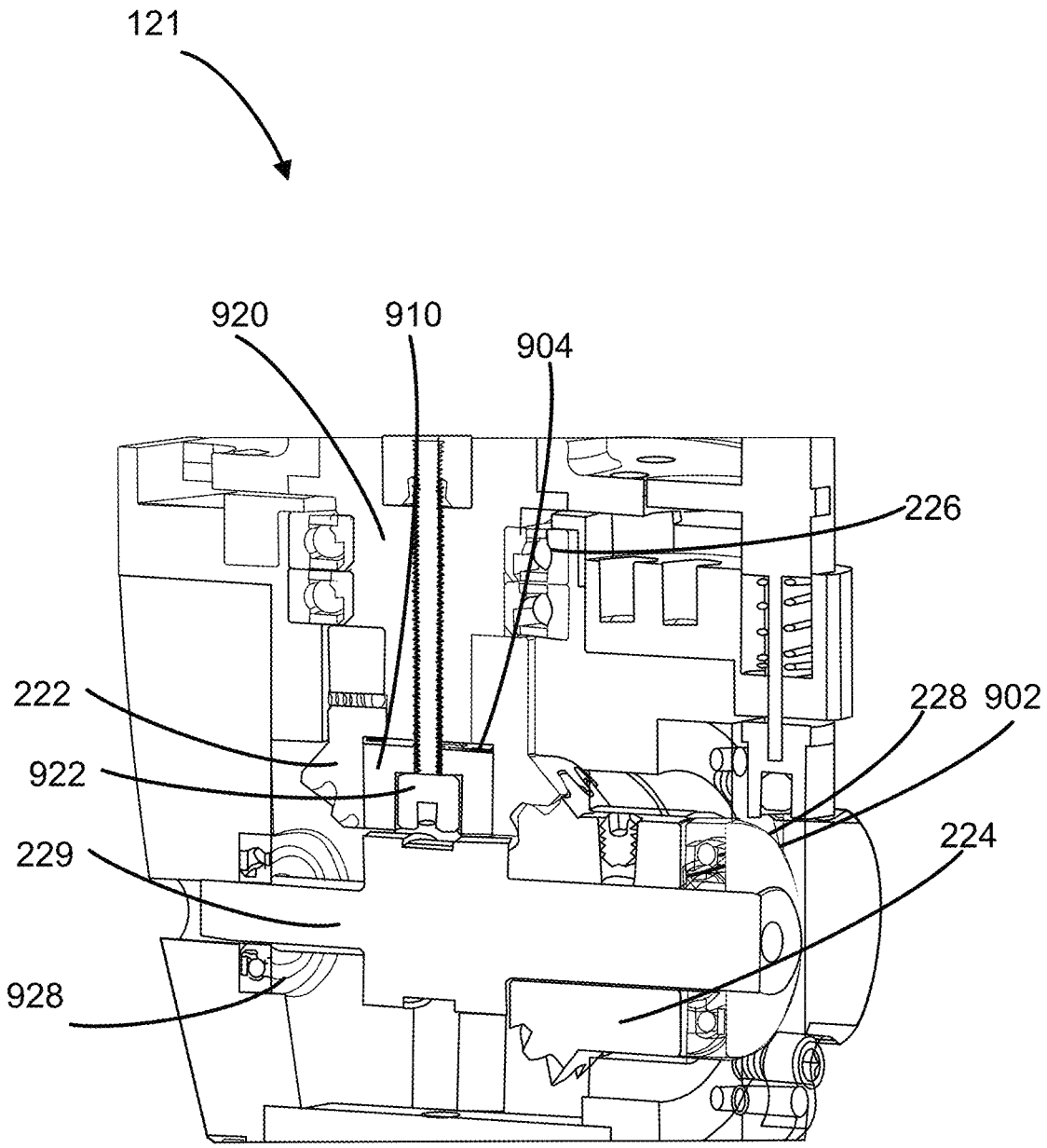
FIG. 9 illustrates a cross-sectional view of a portion of the adaptable belt sander, in accordance with various embodiments.

In various embodiments, a drive system (e.g., drive system 220 from FIG. 3A and drive system 320 from FIG. 3B) can potentially be overly rigid, which may reduce a life of the inadaptable belt sander without additional damping. In this regard, with reference not to FIG. 9) that shows a cross-sectional view of the adaptable belt sander from FIG. 7 along section line A-A with like numerals depicting like elements, the adaptable belt sander 121 can further comprise springs 902, 904 (e.g., wave springs or the like). For example, the spring 902 can be disposed axially between the second gear 224 and the bearing assembly 228. The spring 904 can be disposed axially between a recess in the first gear 222 and a spacing component 910 (e.g., a washer, a bushing, thrust bearing or the like). In this regard, the springs 902, 904 can provide axial damping along axis of rotation for respective gears 222, 224, in accordance with various embodiments.

In various embodiments, the first gear 222 is coupled to a shaft 920 via a fastener 922 that extends from a first end proximate the gear 222 through the shaft 920 to a second end proximate the tool holder 210 as shown in FIG. 3A. In various embodiments, the adaptable belt sander 121 further comprises a third bearing assembly 928 disposed axially opposite the second bearing assembly 228. In this regard, the shaft 229 is configured to rotate smoothly by having bearing assemblies 228, 928 on both axial ends of the shaft 229, in accordance with various embodiments.

The method 600 comprises coupling a first belt sander to a spindle 105 of a CNC machine (e.g., CNC machine 101 or 103 from FIGS. 1A-B) (step 602). The first belt sander may be coupled to the CNC machine via an automatic tool changer ("ATC") of the CNC machine. In various embodiments, the first belt sander may be in accordance with adaptable belt sander 121, adaptable belt sander 300, adaptable belt sander 500, or a combination of the adaptable belt sanders 121, 300, 500. In this regard, the belt sander may include the drive system 220 or the drive system 320. Similarly, the adaptable belt sander may include the spherical ball 562 or the wheel 262. In various embodiments, the first belt sander includes the spherical ball 562 and the spherical ball includes an outer material comprising a polymeric material as described previously herein.

The method 600 further comprises sanding a component with the first belt sander (step 604). In various embodiments, the component may be sanded in areas or portion with a relatively high surface roughness or high number of anomalies relative to other areas of the component. In this regard, the belt sander may be configured to provide greater sanding capabilities for the high number of anomalies/high surface roughness relative to a second belt sander as described further herein.

The method 600 further comprises swapping the first belt sander with a second belt sander (step 606). The first belt sander may be swapped with the second belt sander via the ATC of the CNC machine (e.g., CNC machine 101 or 103 from FIGS. 1A and 1B). In this regard, both belt sanders of method 600 are adaptable for coupling to a CNC machine as described previously herein. In this regard, belt sanders having differing capabilities (e.g., different rotating apparatuses 260, different belt materials, or the like) may be swapped out for use in various stages of sanding/polishing, in accordance with various embodiments. In various embodiments, the second belt sander may be in accordance with adaptable belt sander 121, adaptable belt sander 300, adaptable belt sander 500, or a combination of the adaptable belt sanders 121, 300, 500. In this regard, the belt sander may include the drive system 220 or the drive system 320. Similarly, the belt sander may include the spherical ball 562 or the wheel 262. In various embodiments, the second belt sander includes the wheel 262 and the wheel 262 includes a metallic material as described previously herein. In various embodiments, the first belt sander from step 602 has a first belt material and the second belt sander from step 606 has a second material. In this regard, the first belt sander from step 602 and the second belt sander from step 606 may comprise the same rotating apparatus 260 (e.g., wheel 262 or spherical ball 562) and still having differing capabilities, in accordance with various embodiments. Thus, various configurations of belt sanders may be stored in a tool pocket for a CNC machine and utilized in accordance with method 600 disclosed herein.

The method 600 further comprises sanding the component with the second belt sander (step 608). In various embodiments, the component may be sanded in areas or portion with a relatively high steep contour relative to other areas of the component. In this regard, the second belt sander may be configured to provide greater sanding capabilities for the high number of anomalies/high surface roughness relative to a second belt sander as described further herein.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element.

As used herein, the terms "comprises," "comprising." or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection. When language similar to "at least one of A, B, or C" or "at least one of A, B, and C" is used in the specification or claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. An adaptable belt sander, comprising:

a tool holder configured to couple to a computer numerical control (CNC) machine;

a housing coupled to the tool holder;

a disengagement pin coupled to the housing, the disengagement pin configured to keep the housing in a stationary position relative to the tool holder during operation;

a first gear coupled to the tool holder and a second gear configured to engage the first gear, the second gear coupled to a shaft;

a belt extending from the shaft to a distal end of the adaptable belt sander, the belt configured to travel along a belt path in response to rotation of the shaft, the distal end having a rotating apparatus configured to engage the belt;

a damping system configured to dampen a force of a contact surface of the belt during operation of the adaptable belt sander, wherein the damping system comprises a rod and a piston housing, wherein the rotating apparatus is a spherical ball configured to engage a second distal end of the piston housing of the damping system; and a magnet disposed in the piston housing, the magnet configured to attract the spherical ball.

2. The adaptable belt sander of claim 1, wherein an outer portion of the spherical ball comprises a polymeric material.

3. The adaptable belt sander of claim 1, further comprising an end cam configured to tighten the belt.

4. An adaptable belt sander, comprising:

a tool holder configured to couple to a computer numerical control (CNC) machine;

a housing coupled to the tool holder;

a drive system comprising a turbine disposed in the housing, a first gear, and a second gear configured to engage the first gear, the second gear coupled to a shaft;

a belt system comprising a belt extending from the shaft to a distal end of the adaptable belt sander, the belt configured to travel along a belt path in response to rotation of the shaft, the distal end having a rotating apparatus configured to engage the belt;

a damping system coupled to the housing, the damping system configured to dampen a force of a contact surface of the belt during operation of the adaptable belt sander, the damping system comprising a rod and a piston housing, the rod coupled to a lateral support, the piston housing slidably coupled to the housing, wherein the rotating apparatus is a spherical ball engaging a second distal end of the piston housing; and a magnet disposed in the piston housing, the magnet configured to attract the spherical ball.

5. The adaptable belt sander of claim 4, wherein the turbine is configured to rotate in response to receiving a fluid.

6. The adaptable belt sander of claim 5, wherein the fluid is a coolant.

7. The adaptable belt sander of claim 4, wherein the tool holder remains stationary during operation.

8. The adaptable belt sander of claim 4, further comprising an end cam configured to tighten the belt of the belt system.

* * * * *